US007559571B2

(12) United States Patent
Quaggiotti

(10) Patent No.: US 7,559,571 B2
(45) Date of Patent: Jul. 14, 2009

(54) DOWNHILL SKI WITH THRUST CONTROL STRUCTURE

(76) Inventor: Vittorio Quaggiotti, Via Faggin, 26, 35020 Ponte San Nicolo' (IT)

( * ) Notice: Subject to any disclaimer, the term of this patent is extended or adjusted under 35 U.S.C. 154(b) by 121 days.

(21) Appl. No.: 10/560,038

(22) PCT Filed: Jun. 10, 2004

(86) PCT No.: PCT/EP2004/006276

§ 371 (c)(1),
(2), (4) Date: Dec. 8, 2005

(87) PCT Pub. No.: WO2004/110573

PCT Pub. Date: Dec. 23, 2004

(65) Prior Publication Data

US 2006/0151973 A1 Jul. 13, 2006

(30) Foreign Application Priority Data

Jun. 10, 2003 (IT) ..... VE2003A0021

(51) Int. Cl.
*A63C 5/07* (2006.01)
*A63C 5/075* (2006.01)

(52) U.S. Cl. ..... 280/602; 280/607

(58) Field of Classification Search ..... 280/11.14, 280/11.15, 601, 602, 607–609, 617, 618, 280/809
See application file for complete search history.

(56) References Cited

U.S. PATENT DOCUMENTS 4,007,946 A * 2/1977 Sarver ..... 280/607
4,565,386 A * 1/1986 Crainich ..... 280/602
4,696,487 A * 9/1987 Girard ..... 280/602
4,878,686 A * 11/1989 Quaggiotti ..... 280/602
5,431,427 A * 7/1995 Pieber et al. ..... 280/607
5,447,322 A * 9/1995 le Masson et al. ..... 280/602
5,465,994 A * 11/1995 Commier et al. ..... 280/602
5,556,122 A * 9/1996 Arduin et al. ..... 280/602
5,566,966 A 10/1996 Szafranski et al.
5,647,605 A 7/1997 Arduin
5,704,628 A 1/1998 Boehm et al.
5,806,875 A 9/1998 Bonvallet
5,820,154 A 10/1998 Howe
6,131,939 A * 10/2000 Fels ..... 280/601
6,193,262 B1 * 2/2001 Silva ..... 280/607
6,616,171 B2 * 9/2003 Kruajitch ..... 280/607
6,857,653 B2 * 2/2005 Wilson ..... 280/602
7,134,680 B2 * 11/2006 Emig et al. ..... 280/602
2001/0042969 A1 * 11/2001 Krafft et al. ..... 280/601
2002/0096860 A1 7/2002 Lowe

FOREIGN PATENT DOCUMENTS

EP 0 258 648 3/1888
RU 1 004 144 B 2/2003
WO WO 01/91861 12/2001

* cited by examiner

*Primary Examiner*—Paul N Dickson
*Assistant Examiner*—Vaughn T Coolman
(74) *Attorney, Agent, or Firm*—Hoffman, Wasson & Gitler, P.C.

(57) ABSTRACT

A downhill ski having a thrust support acting elastically downwards on a point in that portion between the front jaw (P) of the binding and the section where the tip curvature commences.

15 Claims, 8 Drawing Sheets

DOWNHILL SKI WITH THRUST CONTROL STRUCTURE

BACKGROUND OF THE INVENTION

The present invention relates to a downhill ski.

As shown schematically in FIG. 1, every ski is known to present a camber, i.e. a downwardly concave curved longitudinal profile, so that when it rests in an unstressed state on a surface, it is raised in its central region 1 (between the heel fixing unit T and the front jaw P of the binding), compared with the tail 2 and shovel portion 3, i.e. the section 4 where the tip curvature commences.

This camber ensures stability during straight-line skiing, however when associated with a certain flexural rigidity it can penalize maneuverability along curves. In this respect, when the skier travels through curved trajectories, assuming that inclined position to achieve a state of instantaneous dynamic equilibrium induced by centrifugal force, the ski no longer adheres to the ground flatly, but instead along its laminated edges and has to counter-flex to assume an elastic deformation with downward convexity (FIGS. 2, 3).

The shape of this elastic deformation, assumed by most commercially available skis, resemble a circular arc (line C of FIG. 2). Experimental trials have shown that during initial access to the curve and then during travel along it, the ski obtains a decided advantage in terms of adherence to the ground, lateral holding, stability and slidability by a shape which, along the front portion of the ski, resembles an elliptical arc much more than a circular arc (line E of FIG. 2), i.e. the elastic counter-flexural deformation concerns the front portion of the ski much more than the central portion 1, to an extent which increases towards the shovel portion 3.

This theory emerges more rationally on examining the distribution of the ground reaction load on the laminated edge of the ski when in an angled position. This distribution (confronting the gravitational and centrifugal action F of the skier) must adequately involve the entire length of the ski, including its ends, particularly the front end, in a sufficiently regular form and to a significant extent (full line in the example of FIG. 4), rather than disproportionately to an insignificant extent (dashed line of FIG. 4), as happens in the majority of commercial products (even those intended for sporting and/or competitive use).

There is in fact an increasing tendency to give the ski a considerable softness, with a consequent unfortunate concentration of the reaction load at the centre (dashed line of FIG. 4). The ability to load the ends is therefore based on a very wide sidecut configuration at the tail and in particular at the shovel portion, in accordance with known carving skis. However this expedient, combined with the said basic softness, results in a load distribution in no way equitable and progressive, but in fact incongruously disproportionate, i.e. an excessive absolute maximum at the centre, excessive relative end maximums, and intermediate regions of almost zero load (dashed line of FIG. 4).

In effect, if only the geometry (sidecut) is varied, a sufficiently effective reaction load distribution can be achieved by giving the ski a considerable rigidity (hence penalizing maneuverability, adherence to the ground and slidability). In contrast, in the case of adequately flexible skis, a partial improvement can be achieved by using an interface plate between the ski and boot, to transmit the skier's action to it in a less concentrated manner. As shown schematically in FIG. 5, a plate fixed to the ski close to its ends can divide the load F exerted by the skier into two forces, F' and F", so beneficially influencing the reaction load distribution. A substantially similar effect could be achieved by a plate fixed to the ski by supports providing more or less large-area or totally continuous contact. In all cases the benefit can only mainly (or exclusively) concern the central region of the ski, and only marginally involve (or not involve) the shovel portion.

If a more involved design in terms of elasticity is to be attempted, the ski must be made rigid along a considerable length of the central region and of that portion behind the front jaw, to then suddenly become flexible by abruptly tapering its thickness in proximity to the shovel portion.

However this can penalize the equipment in terms of fragility and twistability. Hence a structure must be used which is suitable only for the highest level (exclusively reserved for high-level competition), with excessively sophisticated design and production procedures, in contrast to modern requirements of industrial efficiency and economy.

It is an object of the invention is to overcome these contradictions by providing a ski having adequate flexibility with good reaction load distribution.

SUMMARY OF THE INVENTION

This object is attained, according to the invention, by a downhill ski with a thrust support made of a superstructure having a base member, connected to the central region of the ski, and a front promulgation, the end of which exerts elastically a concentrated downward thrust action on a point in that portion of the ski between the jaw (P) of the binding and the section where the tip curvature commences, the connection of the end of the front promulgation to the ski being of the type acting as a bilateral support and a hinge of transverse-horizontal axis, able to inhibit mutual movements in a vertical direction, but such as to enable mutual rotation about the transverse-horizontal direction and mutual sliding in a longitudinal direction.

BRIEF DESCRIPTION OF THE DRAWINGS

A preferred embodiment of the present invention and some variants thereof are described in detail hereinafter by way of non-limiting example with reference to the accompanying drawings, in which.

DETAILED DESCRIPTION OF THE INVENTION

Figure 6:
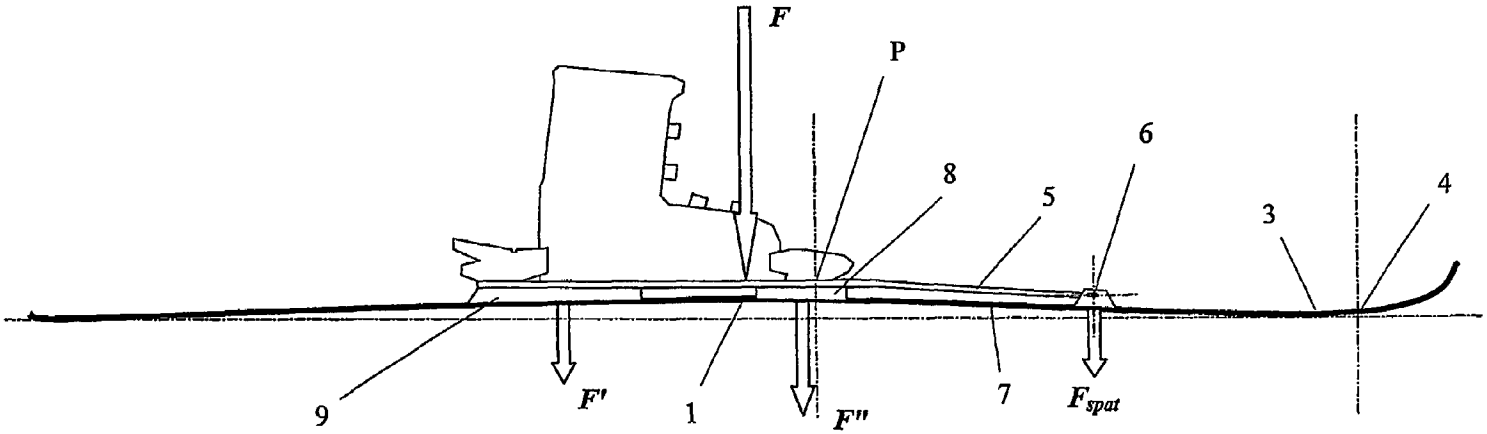
FIG. 6 shows a ski according to the invention.
Figure 7:
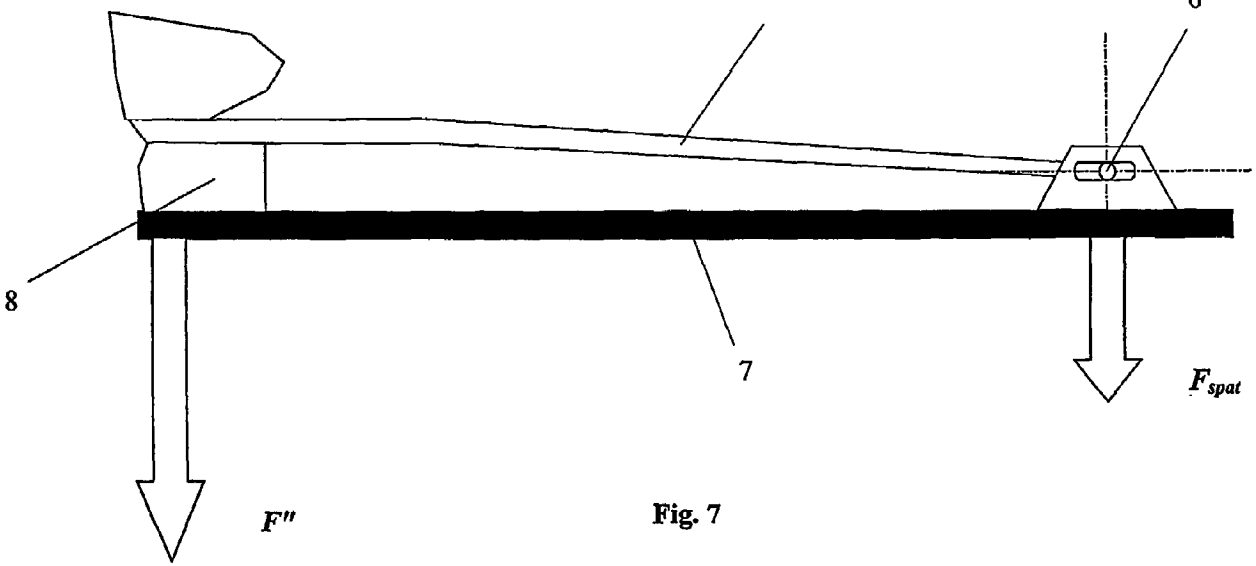
FIG. 7 shows the plate in detail.

As can be seen from FIGS. 6 and 7, the ski of the invention comprises an elastic compensation superstructure provided with a special front constraint in the form of a more complex innovative plate composed not only of the traditional base member (connected to the centre of the ski) but also of a front prolongation 5 which reacts against the (aforedescribed) counter-flexure with a downward thrust $F_{spat}$ on a point 6 situated around the middle of that ski portion between the front jaw P and the section 4 (where the tip curvature commences).

The connection of the ski to the front end of said elongated plate at the point 6 must satisfy precise fundamental connection conditions, allowing freedom of rotation about a transverse-horizontal axis, and freedom of longitudinal sliding, so that no limitation is imposed on the flexibility of the shovel portion itself. This means that said connection must simultaneously act as a hinge and as a bilateral support. In this respect it must allow free rotation of the shovel portion about a transverse-horizontal axis, but must hinder movements between the plate and ski in a vertical direction but must allow relative sliding in a longitudinal direction. It must hence be a hinge (of transverse-horizontal axis), to allow freedom of rotation between the shovel portion and said plate end, but must be horizontally slotted to also allow its relative longitudinal sliding; it can hence be defined as a slotted hinge.

This superstructure is therefore provided with at least three separate points of application to the ski, one of which is situated in a position 6 which is significantly advanced (with respect to the front jaw), possibly and preferably around the middle of the portion between the front jaw P and the section 4 where the curvature of the tip commences. Consequently when the ski counter-flexes, the dynamic load F exerted by the skier is divided into at least three forces: two (F', F") or more acting on the base central region, and an additional force ($F_{spat}$) acting on said more advanced point 6.

Figure 1:
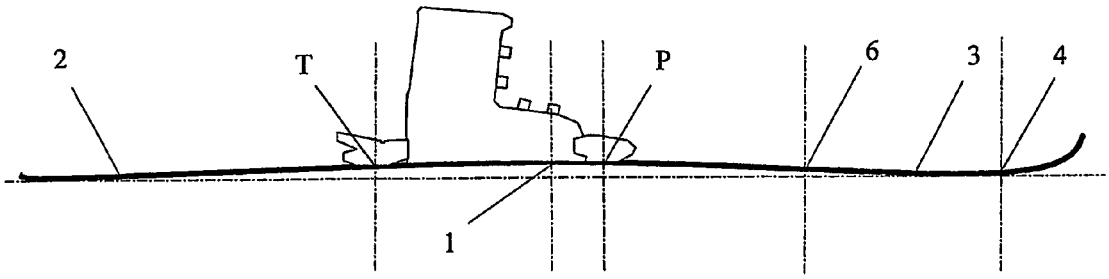
FIG. 1 is a side view of a traditional ski.
Figure 2:
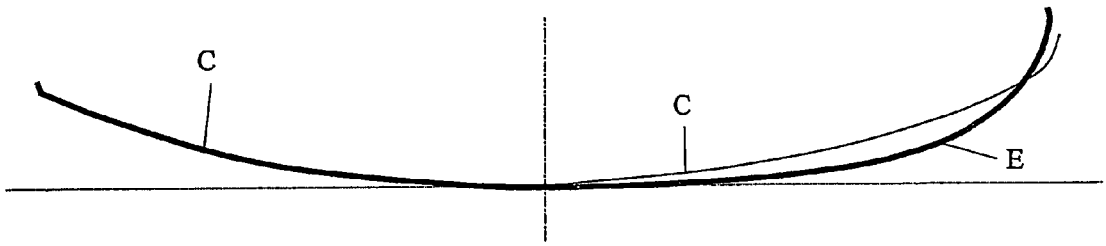
FIG. 2 shows it while undergoing a curve.
Figure 3:
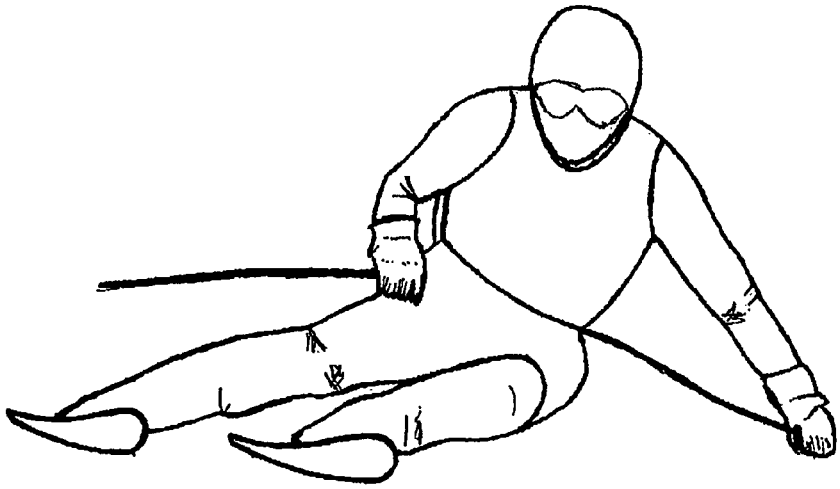
FIG. 3 shows a skier while undergoing a curve.
Figure 4:
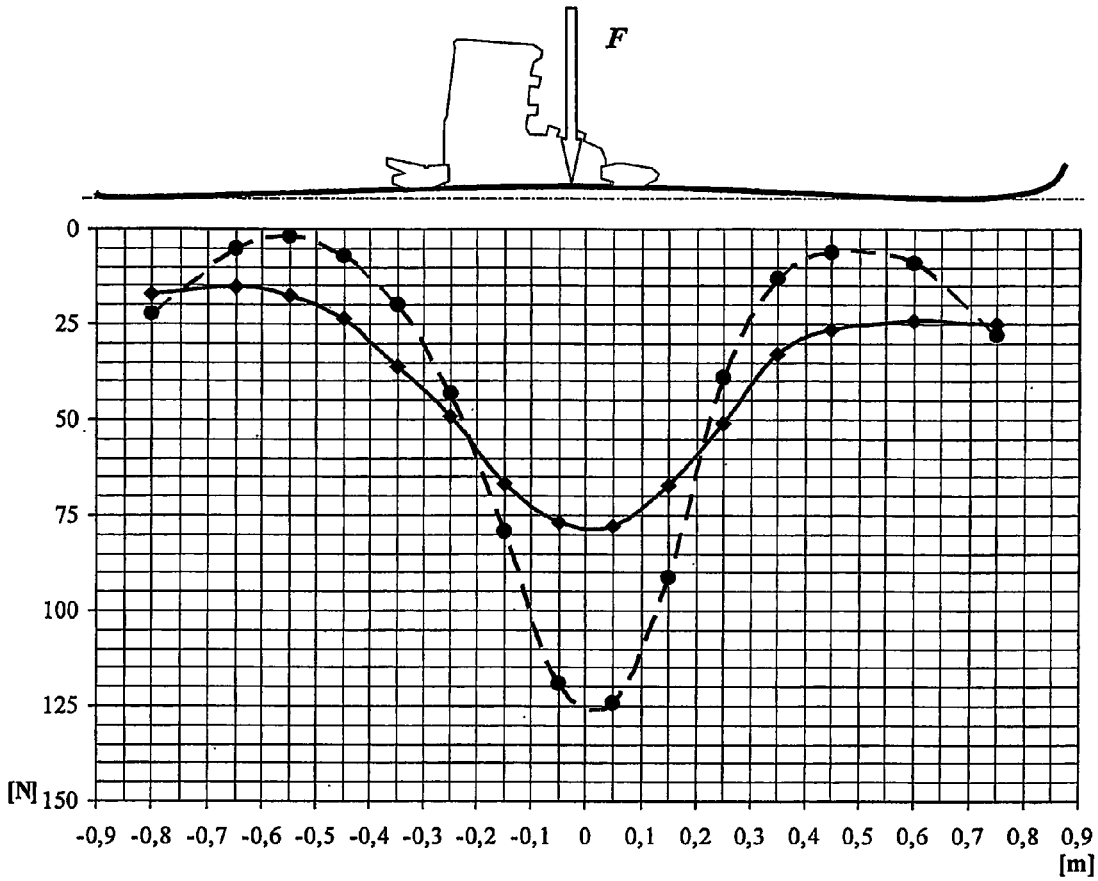
FIG. 4 shows the reaction load distribution diagram.
Figure 5:
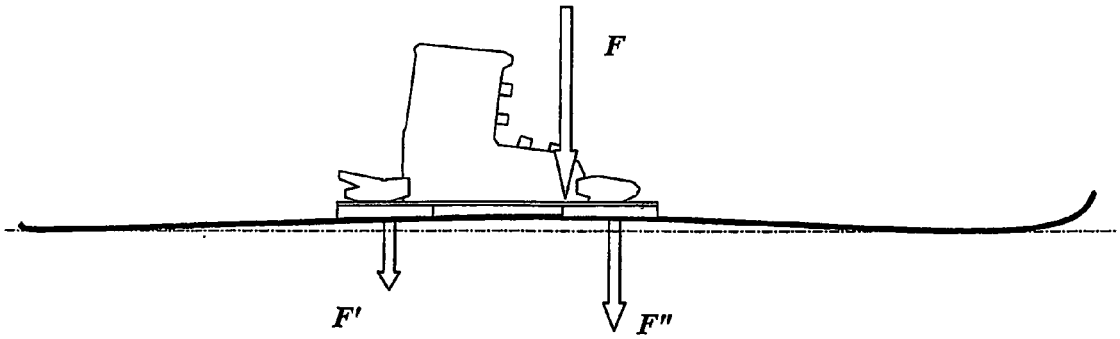
FIG. 5 shows a ski provided with a plate in accordance with the known art.

It should be noted that the most significant role of this superstructure is not merely to damp and absorb vibrations, although it undoubtedly and effectively performs this valuable accessory function. Its main role is to exert a supplementary reactive thrust $F_{spat}$ on the point 6, to induce an elastic compensation effect thereat to significantly modify its counter-flexure deformation; it hence achieves the desired effect on the elastic deformation and on the related distribution of the reaction load (FIG. 4). It should however be noted that this effect is also substantially dependent on the elastic characteristics of the basic ski, which has to be adequately flexible particularly in the portion 7 below the arm 5.

The proposed configuration shown by way of example in FIGS. 6 and 7 can be subjected to suitable improvement. In this respect, to be applicable to any ski it cannot be prefigured in a standardized form; it requires adaptation to the shape (in terms of the progression of the thicknesses and curvatures) of the ski for which it is intended. Moreover, the value of the thrust $F_{spat}$ is strictly dependent on the flexibility of the arm and would be very difficult to regulate and preset (in order to achieve a determined preload value and assume certain values increasing with the elastic counter-flexure deformation).

The aforesaid problem is radically simplified by using the following more evolved constructional variant (FIGS. 8-11).

The superstructure is no longer a single member but two members: a traditional base plate 10 and an independent semi-rigid front prolongation arm 11, i.e. a sort of rocker arm (FIG. 8), as described hereinafter.

The prolongation arm 11, connected at its front to the slotted hinge 6, is connected at its rear to the front end of the base plate 10 by a hinge 12, it being also provided with a retro-prolongation 13 the end of which acts as a reaction element. Said end is provided with an element 14 of adjustable advancement (for example by means of a screw), which abuts against the base plate 10 (FIGS. 8, 9) or against the basic ski (FIGS. 10, 11), according to design requirements related to its elastic characteristics, by acting preferably on an interposed elastic or semi-elastic element 15 (for example a high resistance rubber insert).

It should be noted that in the second of the aforesaid cases, in which the design provides for the reaction element of the rocker arm to bear on the basic ski (FIGS. 10, 11), two supplementary forces act frontward through the rocker arm: in addition to the force $F_{spat}$, the force F"' exerted by the element 14 also acts on the ski.

Figure 12:
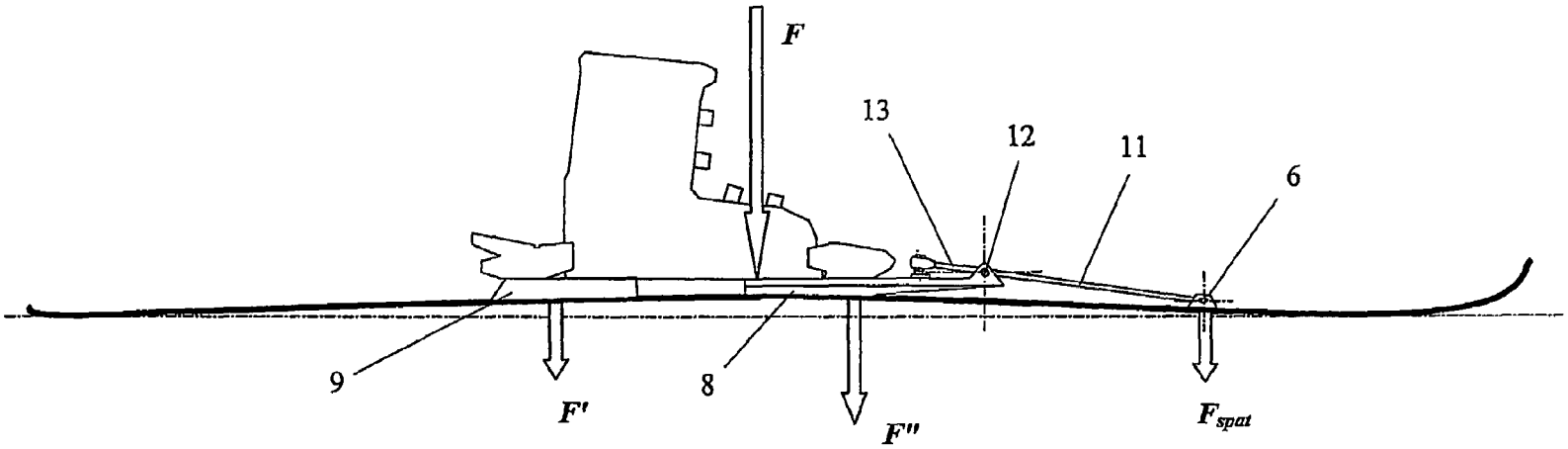
Figure 13:
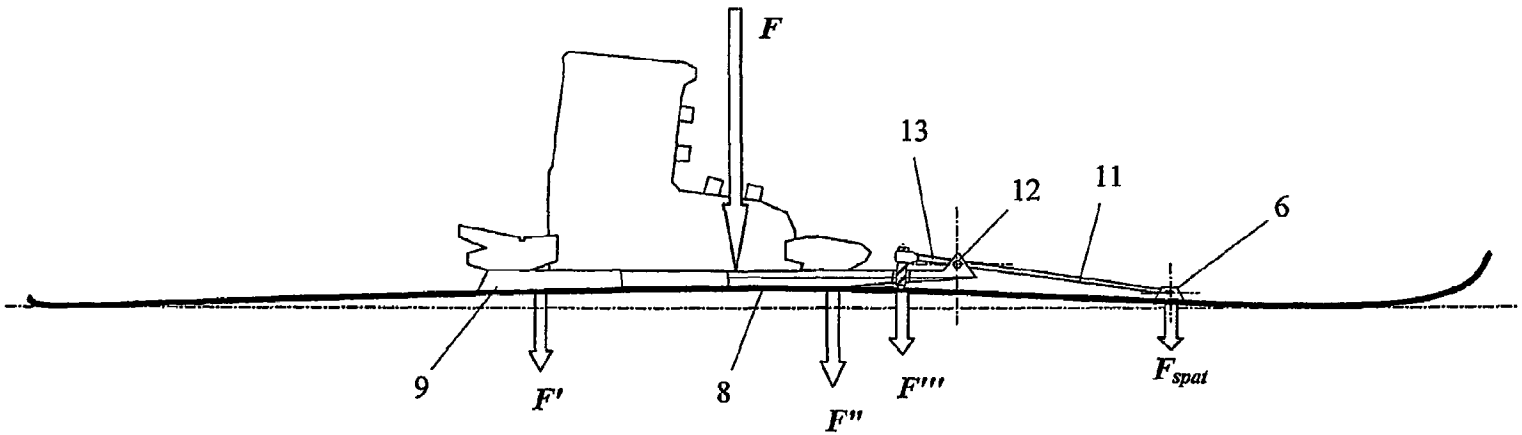

As an alternative to the aforedescribed proposed configurations, the base plate can be split into two half-plates, i.e. the superstructure portion below the boot comprises two distinct separated parts: a rear part 9 below the heel fixing unit, and a front part 8 below the sole. This latter provides all the aforedescribed functional aspects, as illustrated in FIG. 12, which shows an extension of the structure already shown in FIG. 8, and in FIG. 13 which shows an extension of the structure shown in FIG. 10.

Figure 8:
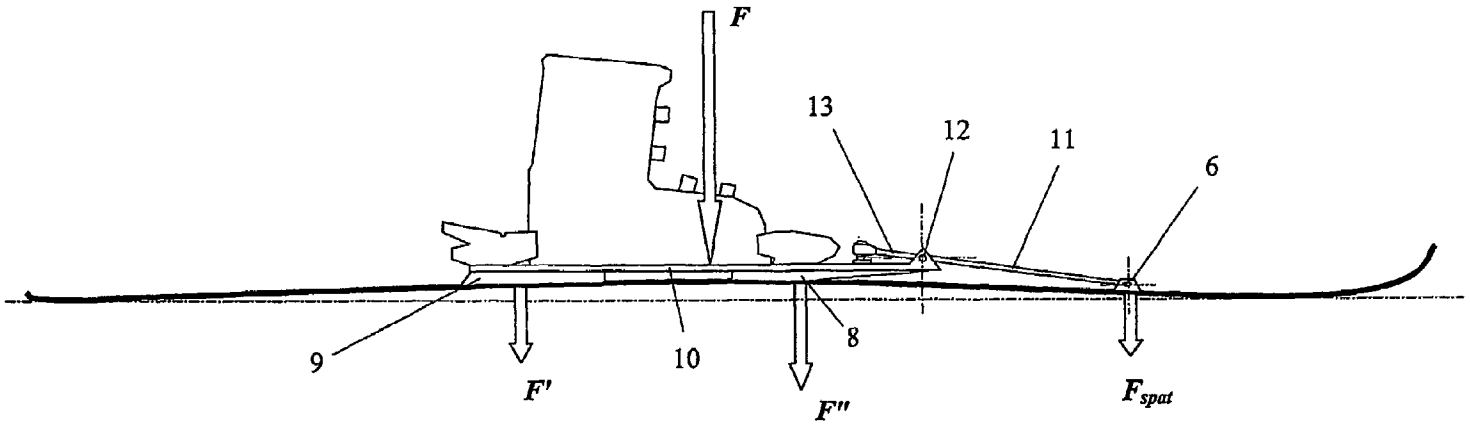
FIGS. 8 to 17 show variants of the ski.
Figure 9:
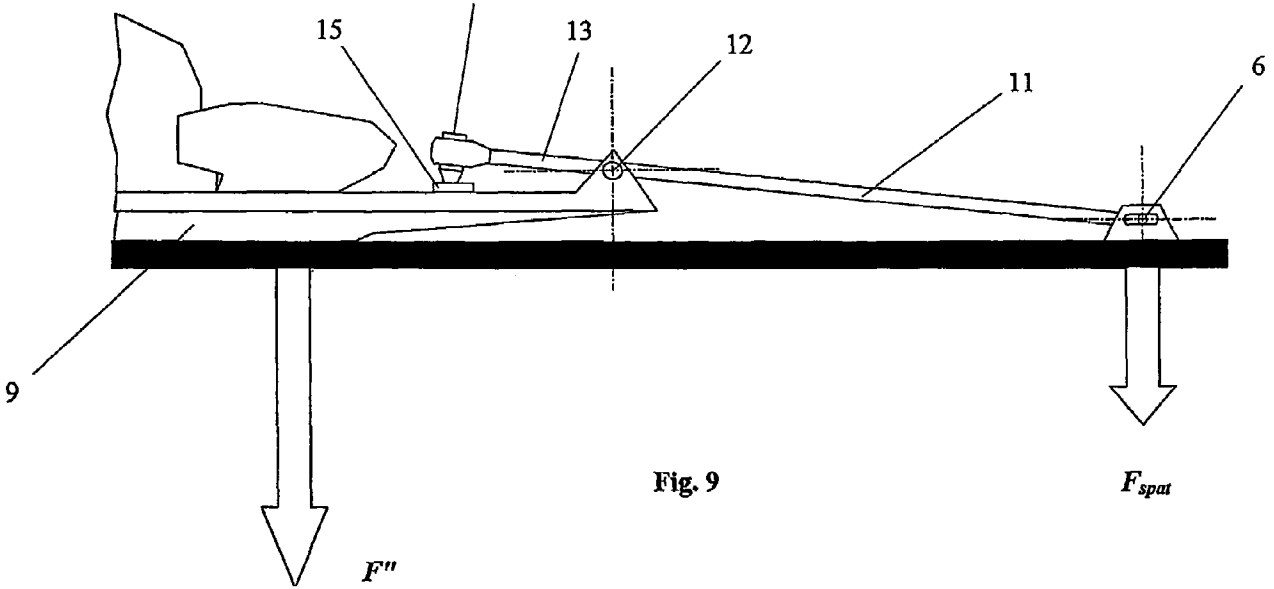
Figure 10:
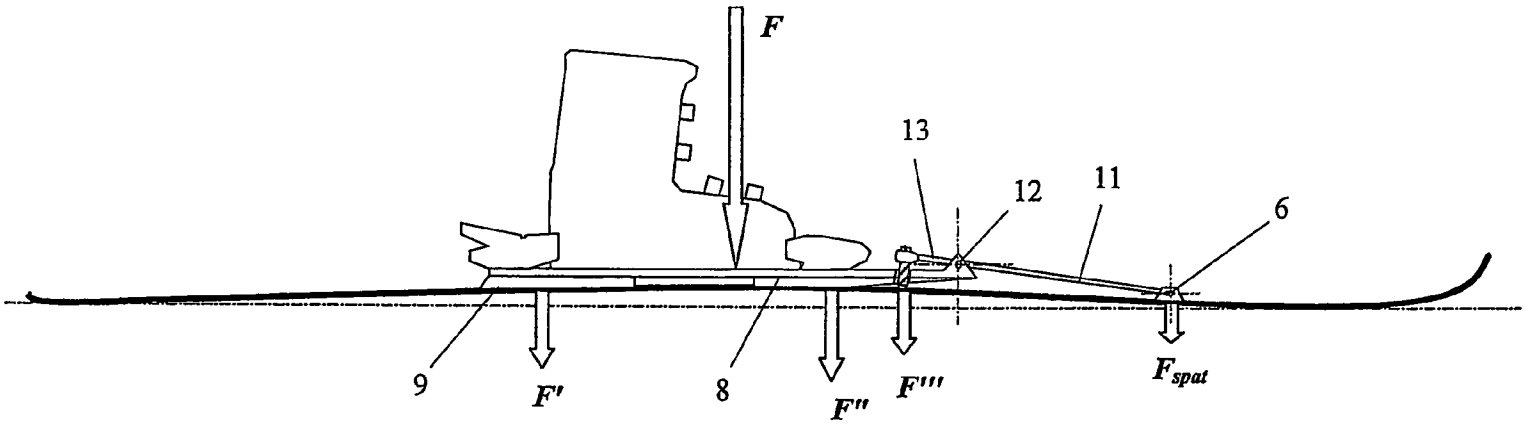
Figure 11:
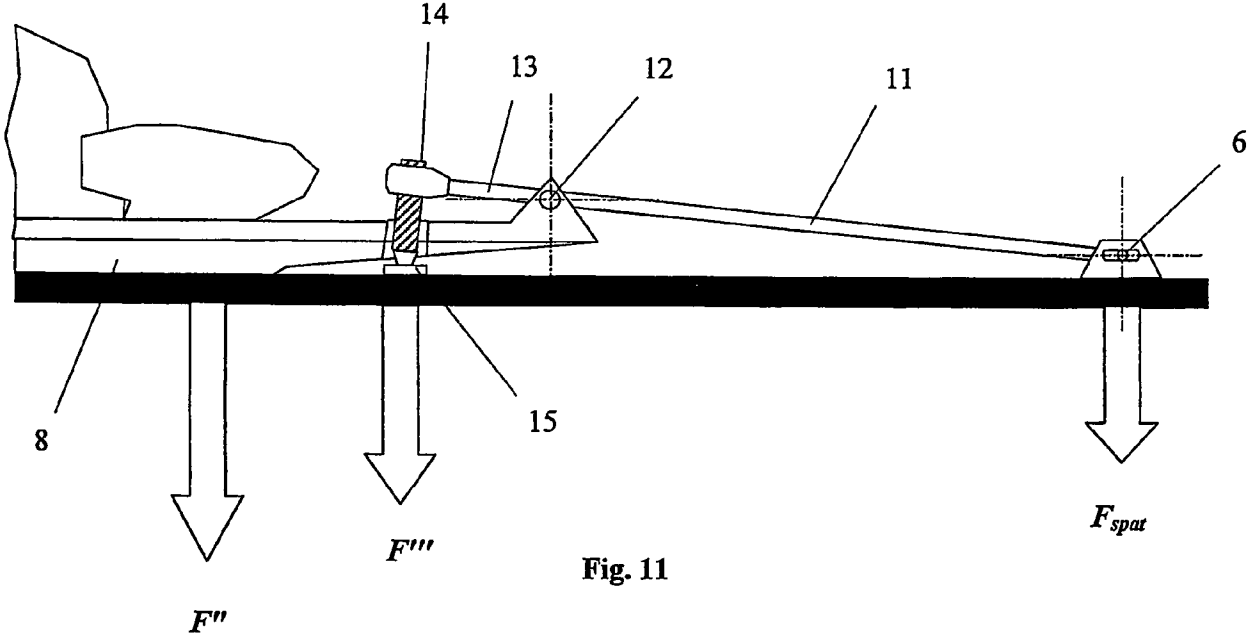
Figure 14:
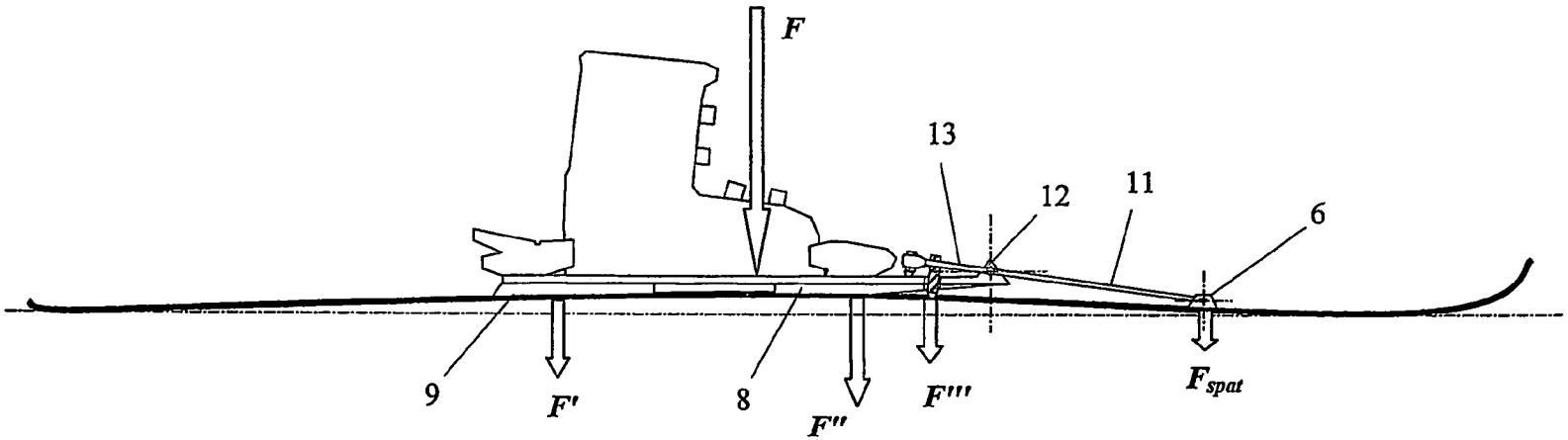
Figure 15:
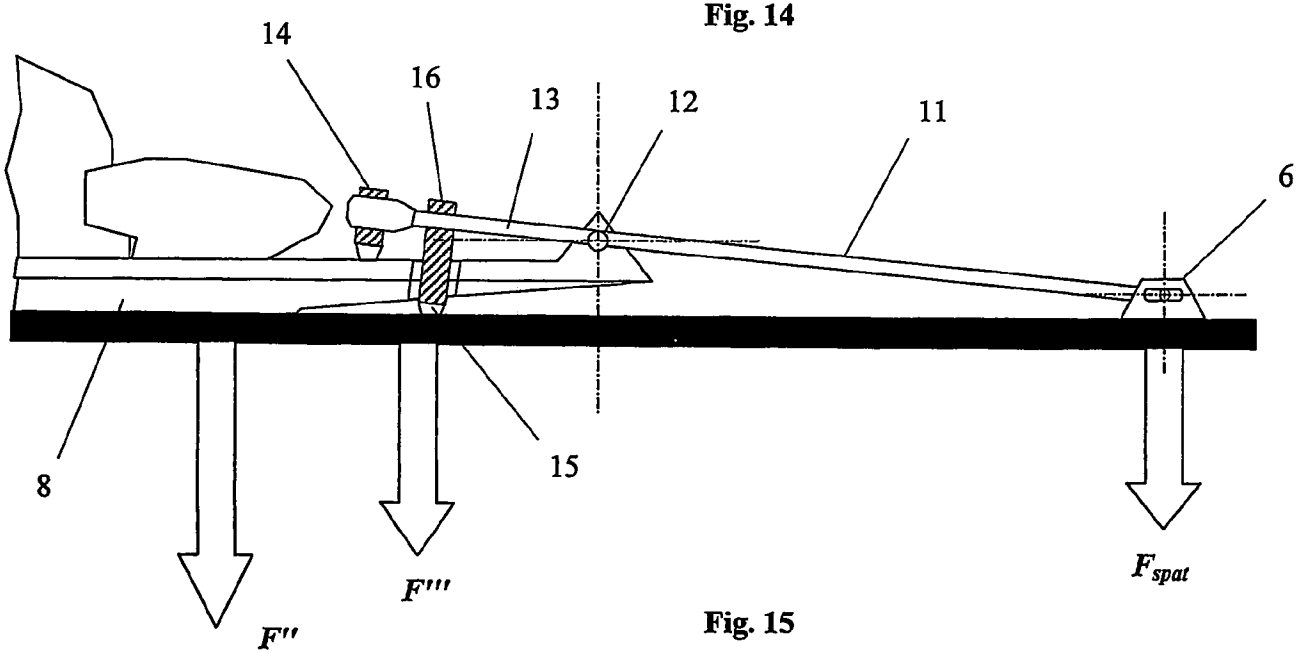

Finally, the solution shown in FIGS. 8, 9 and the solution shown in FIGS. 10, 11 can be simultaneously adopted (whether the base plate is whole or split), by simultaneously applying a first counteracting element 14 acting on the base plate, and a second counteracting element 16 acting on the ski, as shown in FIGS. 14 and 15.

Figure 16:
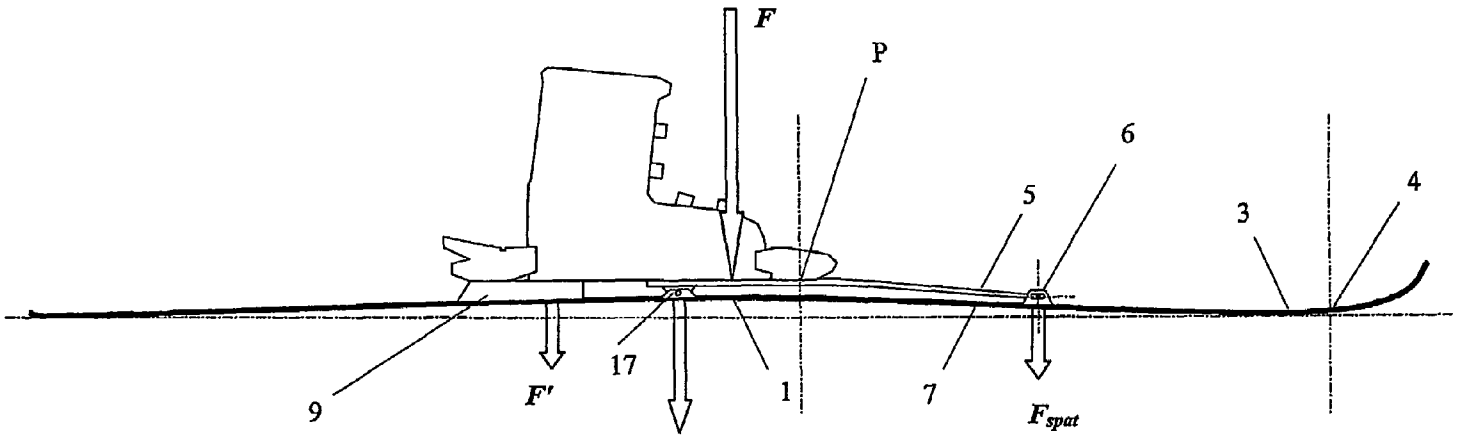
Figure 17:
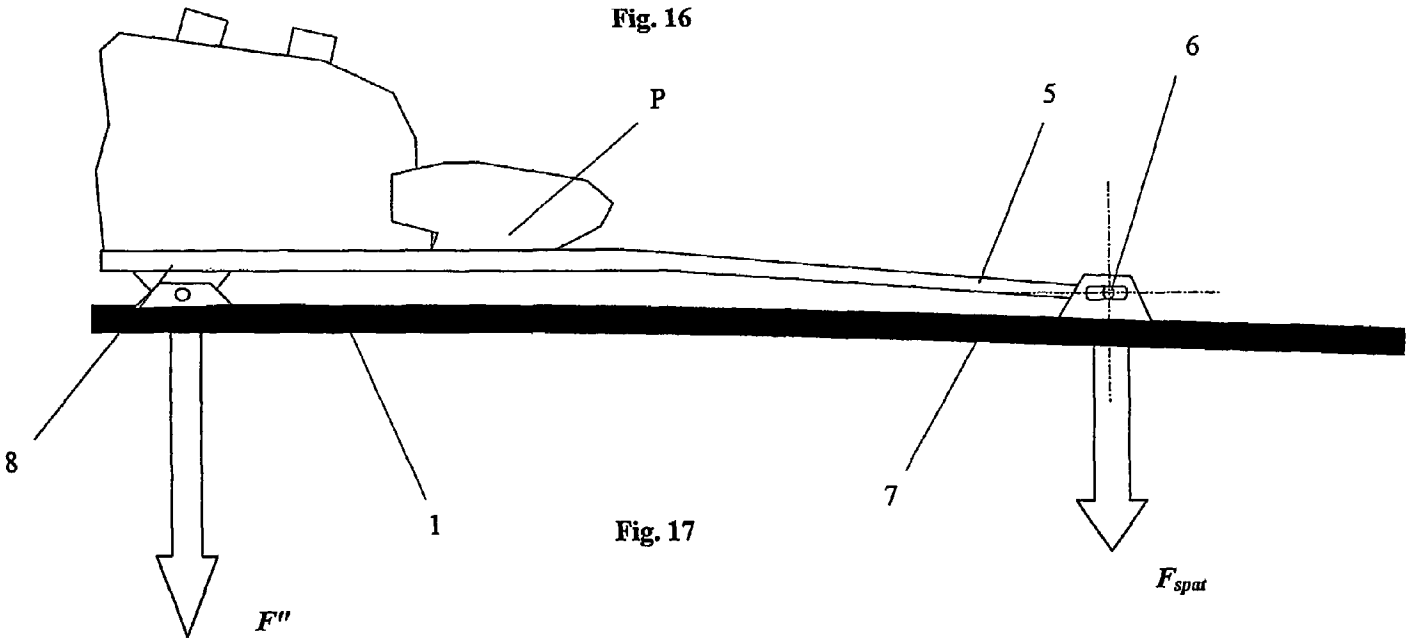

A further embodiment (very particular, moreover for its simplicity), is shown in FIGS. 16 and 17. It concerns exclusively the solution in which the base plate is fractioned into two different and separated parts 8 and 9. It involves only the front part 8 and it foresees the prolongation arm 5 to be integral part of it up to point 6 (fixed to the ski in the "slotted hinge" way as described and considered up to now). Said front plate portion (underneath the boot sole) is fixed to the central region 1 of the ski through a transverse-horizontal axis solid hinge 17, at the rear with respect to the front jaw P. In this case the action F of the skier is transmitted to the ski by three forces: the F' one exerted on the heel fixing unit, the Fspat exerted by the end 6 of the arm and the F" one exerted on the aforesaid hinge.

Independently of the embodiment used, the ski of the invention is particularly advantageous by demonstrating an adequate flexibility combined with good distribution of the reaction load.

The superstructure of the ski according to the invention can be constructed of traditional materials or, advantageously, of different materials such as composites, magnesium alloys, or monostructural hybrids which enable a specific weight reduction to be obtained for equal strength characteristics.

In addition, the superstructure can be produced using economical industrial pressing, forging and moulding techniques.

What is claimed is:

1. A downhill ski comprising a tail region, a central region, a shovel region, a tip having a curvature, and a longitudinal axis extending from the tail region to the tip, a binding having a front jaw and a heel a superstructure connected to the central region, the superstructure having a base member supporting said front jaw and said heel of the binding, and a front prolongation reacting to the shovel upward movements, a free end of the front prolongation exerting a downward thrust action on a portion of the ski between the front jaw of the binding and the section where the tip curvature commences, a bracket extending from the shovel region, the bracket having a horizontal slot extending along said longitudinal axis, a free end of the front prolongation connected to the bracket, the end of front prolongation being engaged with and movable along the horizontal slot, so that the end of the front prolongation is allowed to rotate and slide along said longitudinal slot.

2. The ski as claimed in claim 1, wherein the superstructure acts on a point substantially at the centre of that portion between the front jaw (P) of the binding and the section where the tip curvature commences.

3. The ski as claimed in claim 1, wherein the superstructure acts on a point situated in the rear half of that portion between the front jaw (P) of the binding and the section where the tip curvature commences.

4. The ski as claimed in claim 1, wherein the base member is split into two half-members, namely a rear half member for raising the heel of the binding, and a front half-member below the front part of a boot.

5. The ski as claimed in claim 1, wherein the front prolongation and at least the front portion of said base member form a monolithic entity.

6. The ski as claimed in claim 4, wherein the front prolongation is connected at its rear to the front portion of said base member by a hinge and is provided with a retro-prolongation extending from said hinge and acts as a reacting element on the base member by means of a counteracting element.

7. The ski as claimed in claim 4, wherein the front prolongation is connected at its rear to a front portion of said base member by a hinge and is provided with a retro-prolongation which extends from said hinge and acts as a reacting element on the ski by means of a counteracting element.

8. The ski as claimed 6, wherein the front prolongation further comprises a second counteracting element.

9. The ski as claimed in claim 6, wherein the counteracting element is of adjustable feed.

10. The ski as claimed in claim 9, wherein the counteracting element has a substantially elastic insert.

11. The ski as claimed in claim 10, wherein the insert is formed of high-resistance rubber.

12. The ski as claimed in claim 7, wherein the counteracting element is of adjustable feed.

13. The ski as claimed in claim 12, wherein the counteracting element has a substantially elastic insert.

14. The ski as claimed in claim 8, wherein the counteracting element is of adjustable feed.

15. The ski as claimed in claim 14, wherein a substantially elastic insert is associated with the counteracting element.

* * * * *